United States Patent [19]

Onishi et al.

[11] 4,315,493

[45] Feb. 16, 1982

[54] INTERNAL COMBUSTION ENGINE IGNITION DEVICE

[75] Inventors: Masayoshi Onishi; Yoshikatu Haruta; Toshiyuki Sakurai; Shigemi Yamamoto, all of Himeji, Japan

[73] Assignee: Mitsubishi Denki Kabushiki Kaisha, Tokyo, Japan

[21] Appl. No.: 92,753

[22] Filed: Nov. 9, 1979

[30] Foreign Application Priority Data

Nov. 16, 1978 [JP] Japan ..... 53/142074
Nov. 16, 1978 [JP] Japan ..... 53/158451[U]
Nov. 16, 1978 [JP] Japan ..... 53/158452[U]

[51] Int. Cl.[3] ..... F02P 1/00
[52] U.S. Cl. ..... 123/617; 123/146.5 A
[58] Field of Search ..... 123/148 E, 146.5 A, 123/148 R, 117 R, 117 A, 414, 612, 595, 617, 618, 647; 200/19 M, 19 R

[56] References Cited

U.S. PATENT DOCUMENTS 3,820,521 6/1974 Longstaff-Tyrrell ..... 123/146.5 A
3,888,225 6/1975 Boyer et al. ..... 123/617
3,906,920 9/1975 Hemphill ..... 123/148 E
3,964,456 6/1976 Eshelman ..... 123/117 R

FOREIGN PATENT DOCUMENTS 2298011 8/1976 France ..... 123/146.5 A
2000386 1/1979 United Kingdom ..... 123/146.5 A

*Primary Examiner*—P. S. Lall
*Attorney, Agent, or Firm*—Wenderoth, Lind & Ponack

[57] ABSTRACT

The disclosed ignition device for a four-cylinder engine includes an ignition unit performing the ignition function in response to ignition signals. A rotor and a stator disposed in a metallic housing to serve to generate the ignition signals include four protrusions and three protuberances respectively. By rendering the number of the protuberances smaller than that of the protrusions, a space is left in the housing. Two bearing seats are disposed in the space at the opening of the housing and the ignition unit is screwed to the bearing seats.

12 Claims, 6 Drawing Figures

INTERNAL COMBUSTION ENGINE IGNITION DEVICE

BACKGROUND OF THE INVENTION

This invention relates to an ignition device for an internal combustion engine including a semiconductor amplifier circuit for the ignition function and formed as a single ignition unit which is, in turn, accommodated in a housing for a distributor.

One conventional ignition device of the type referred to is disclosed in Japanese patent publication No. 30818/1969 as including an electronic circuit for sensing the ignition position fixed in a hole cut out of a movable plate. The ignition device disclosed in the above cited patent publication is disadvantageous in that a semiconductor amplifier circuit constituting the ignition circuits and fixed to a movable plate cannot be provided because the space occupied by the semiconductor amplifier circuit is very small and the effect of heat dissipation is also extremely poor.

Also Japanese patent publication No. 26527/1970 discloses an ignition device including an ignition amplifier disposed in a housing for a distributor. The ignition device disclosed in the latter patent publication has an ignition amplifier composed of power transistors and other circuit elements which are mounted separately and directly at the bottom of the housing. This has resulted in the disadvantages that the mounting operation is extremely difficult and moreover it can only be provided if a governor advance device is omitted.

Accordingly, it is a general object of the present invention to overcome the disadvantages of the prior art devices as described above.

It is an object of the present invention to provide a new and improved ignition device for an internal combustion engine including a signal unit for generating ignition signals, an ignition unit separate from the signal unit to amplify the ignition signals, and a housing for a distributor in which the ignition unit is detachably mounted along with the signal unit.

It is another object of the present invention to provide a new and improved ignition device for an internal combustion engine including a signal unit for generating ignition signals and an ignition unit for amplifying the ignition signals, the signal and the ignition units being separate from each other and easily electrically connected to each other.

It is still another object of the present invention to provide a new and improved ignition device for an internal combustion engine including a signal unit for generating ignition signals, an ignition unit for amplifying the ignition signals and a housing for a distributor, in which the signal unit can be easily positioned so that the ignition unit can be easily mounted in and removed from the housing.

SUMMARY OF THE INVENTION

The present invention provides an ignition device for an internal combustion engine comprising a housing, a signal unit for generating ignition signals, and an ignition unit for amplifying the ignition signals, the ignition unit being fitted onto the signal unit and accommodated in the housing with the signal unit.

In a preferred embodiment of the present invention, the ignition device comprises a heat dissipation housing in which a rotary shaft is journalled, a signal unit fixed within the housing to generate ignition signals by the rotation of the rotary shaft, the signal unit having a flat end portion having a pair of output terminals extending perpendicularly to the flat end portion, the ignition signals being outputted through the terminals, and an ignition unit fixed within the housing opposed to the flat end portion of the signal unit and including a pair of input terminals into which the terminals on the signal unit are fitted and a pair of output terminals one of which is connected to an ignition coil, the input and output terminals extending in a common direction perpendicular to the flat end portion of the signal unit, the ignition unit being detachably mounted in the housing so that it can be mounted and removed from the latter radially thereof.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
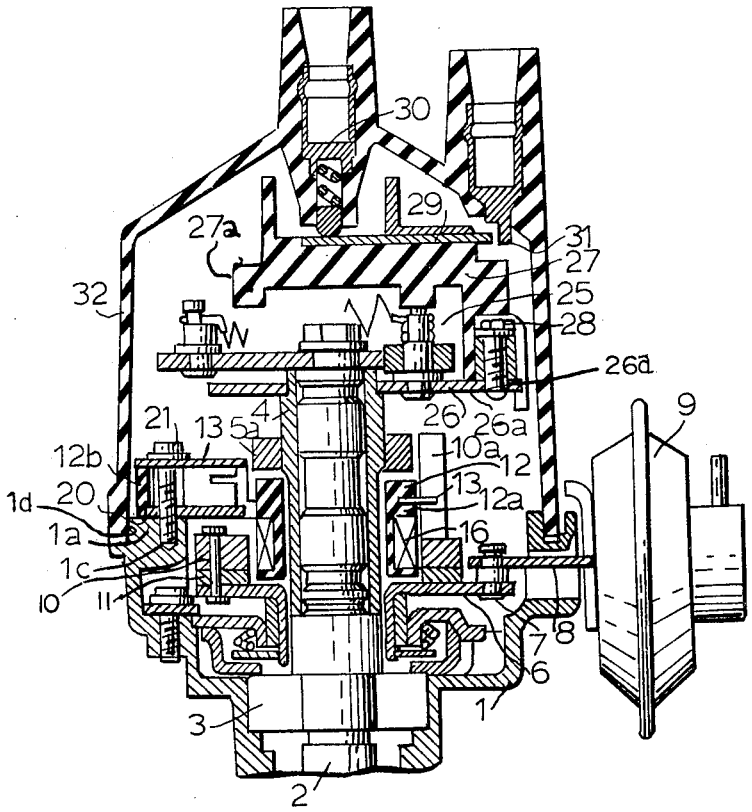
FIG. 1 is a fragmental longitudinal sectional view of one embodiment of the engine ignition device according to the present invention with parts illustrated in elevation.

Referring now to FIG. 1 of the drawings, there is illustrated one embodiment of the engine ignition device incorporating the present invention. The arrangement illustrated comprises a bowl-shaped housing 1 for a distributor and which is made of a material having good heat dissipation characteristics, for example, aluminum. As shown best in FIG. 4, the housing 1 includes a pair of spaced bearing seats 1*a* integral with the inner wall surface thereof and axially extending to the open end thereof. Each of the bearing seats 1*a* has a relatively large surface area. A pair of projections 1*b* is disposed in each of two diametrically opposite positions approximately symetric with respect to the longitudinal axis of the housing 1 and attached to the inner wall surface thereof with a predetermined space therebetween and a threaded hole 1*c* is disposed at a predetermined position in each bearing surface 1*a*. The projections 1*b* project somewhat beyond the bearing surfaces 1*a*. Each of the bearing seat 1*a* has a radially outer edge defined by a peripheral wall surface extending downwardly therefrom as viewed in FIG. 1. The peripheral wall surfaces are interconnected by an intermediate connecting wall to form a semicylindrical peripheral surface of a projections 1*d* serving as one component of a faucet joint.

Figure 2:
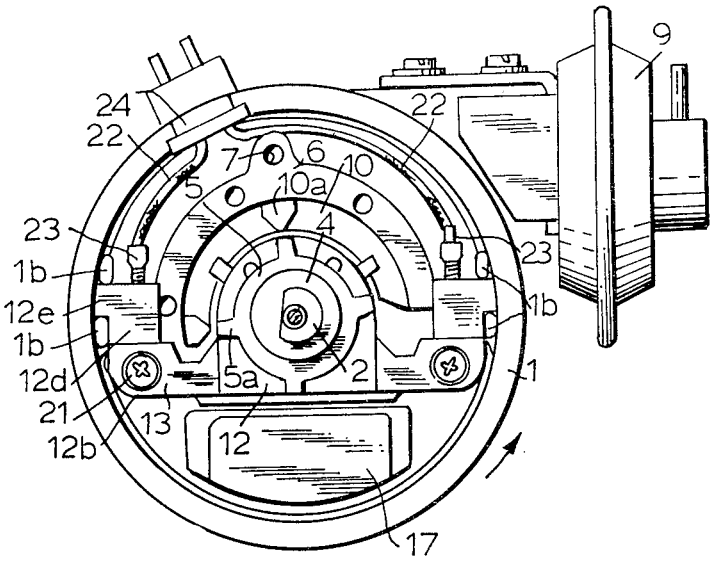
FIG. 2 is a plan view of the lower half of the device shown in FIG. 1.

The arrangement further comprises a rotary shaft 2 journalled in a bearing 3 disposed on one end portion, in this case the lower end portion as viewed in FIG. 1, of the housing and rotated by an associated internal combustion engine (not shown), a hollow cylindrical member 4 of a magnetic material loosely fitted onto the rotary shaft 2 for relative movement with respect thereto, and an annular signal rotor 5 fixedly mounted on the cylindrical member and having on the radially outer periphery a plurality of radially outwardly directed protrusions 5*a* disposed at predetermined equal angular intervals. The signal rotor 5 is formed of a magnetic material and as shown in FIG. 2 has four protrusions 5*a* acting as magnetic modulators because the internal combustion engine (not shown) has four cylinders.

A movable annular magnetic plate 6 is disposed around the lower end as viewed in FIG. 1 of the hollow cylindrical member 4 for rotation about the axis of the rotary shaft 2 and includes a connecting pin 7 located on the outer periphery thereof. The connecting pin 7 has loosely fitted thereonto a link 8 of an angle advance device 9 disposed outside the housing 1. An annular magnetic stator 10 and a permanent magnet 11 are fixedly secured on the movable plate 6 by rivets and the stator 10 has axial protuberances 10*a* located at predetermined equal angular intervals thereon. The number of protuberances 10*a* is less the number of the protrusions 5*a* on the signal rotor 5 by at least one. In the example illustrated, the stator 10 includes three protuberances 10*a* which, during the rotation of the rotor 5, are successively approached by and are opposed to the protrusions 5*a* on the movable plate 5 with a predetermined gap formed therebetween after which the protrusions 5*a* are increasingly spaced from the protuberances 10*a* (see FIG. 2).

Figure 5:
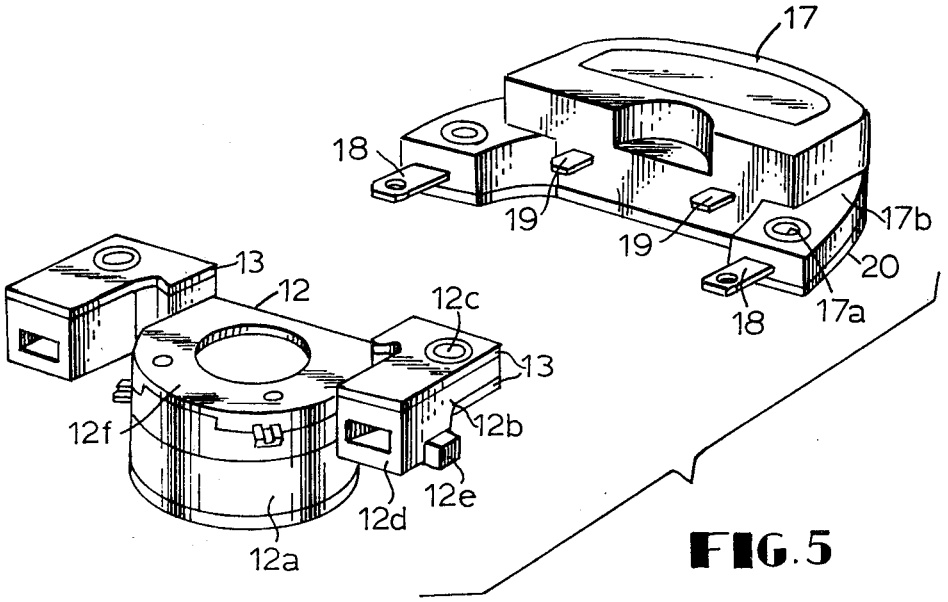
FIG. 5 is a perspective view of the signal and ignition units shown in FIG. 2 spaced from each other.

The embodiment also comprises a signal unit 12 fixed to the housing 1. As shown best in FIG. 5, according to the present invention, the signal unit 12 has a shape which fits in a cross-section in the form of a segment of a circle (see FIG. 6) and includes a bobbin portion 12*a*, a pair of supporting portions 12*b* disposed parallel to each other on opposite sides of the bobbin portion 12*a*, and having respective mounting holes 12*c*, a pair of connecting housing portions 12*d* extending in a common direction from the supporting portions 12*c* to form extensions of the latter respectively, a pair of positioning portions 12*e* extending perpendicularly from the housing portions 12*b* and being positioned to engage between the projections 1*b* respectively and a cover 12*f*. As shown best in Figure the bobbin portion 12*a* includes a flat end portion defined by the chord of the segment of a circle corresponding to the cross-section of the interior of the housing 1 and flush with the free end portions of the supporting portions 12*c*. Further a pair of metallic covers 13 are shown in FIG. 5 as having the respective supporting portions 12*b* sandwiched therebetween.

The bobbin portion 12*a*, the supporting portions 12*b*, the mounting holes 12*c*, the connector housing portions 12*d* and the positioning portions 12*e* are formed by molding any suitable synthetic resinous material. The metallic covers 13 are fixed to the associated supporting portions 12*b*. If desired, the metallic covers 13 may be omitted.

Figure 6:
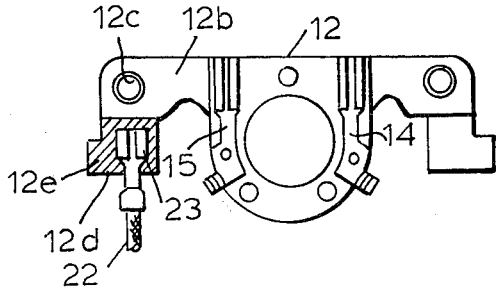
FIG. 6 is a plan view, partly in section, of an essential part of the signal unit shown in FIG. 5.

As shown in FIG. 6, the bobbin portion 12*a* is provided on the flat end portion with a pair of connecting terminals 14 and 15 which are extend perpendicularly to the flat end portion and, in turn, are electrically connected to the start and end of a signal coil 16 (see FIG. 1) wound around the bobbin portion 12*a*. As shown in FIG. 1, the bobbin portion 12*a* is disposed coaxially with the longitudinal axis of the rotary shaft 2.

Figure 3:
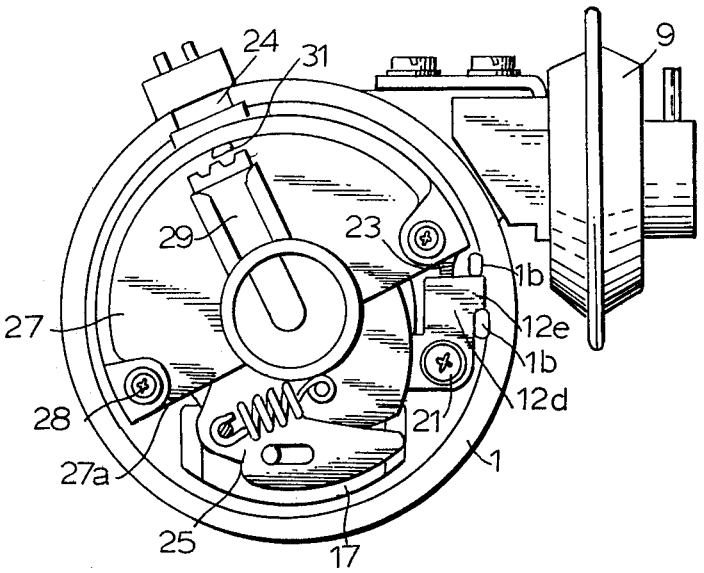
FIG. 3 is a plan view of the arrangement shown in FIG. 1 with the distribution rotor and the distributor cap shown in FIG. 1 removed.

Further, an ignition unit 17 is located in the housing 1 in a position opposed to the flat end portion of the signal unit 12 as shown in FIGS. 2 and 3, and has disposed therein a semiconductor amplifier (not shown) functioning as the ignition circuit for the internal combustion engine. The semiconductor amplifier may be formed, for example, of an integrated circuit well known in the art.

As shown best in FIG. 5, the ignition unit 17 has a cross-section generally in the shape of a semicircle and also has a pair of mounting holes 17*a* in a pair of mounting portions 17*b* which are, in turn, parallel to the pair of the supporting portions 12*b* of the signal unit 12. The ignition unit 17 further includes a pair of output terminals 18 projecting in a common direction from the respective mounting portions 17*b* and positioned to electrically connect the semiconductor amplifier (not shown) to an associated ignition coil or an electric source (neither the ignition coil nor the electric source is illustrated). A pair of spaced input terminals 19 are provided on the central portion of the main body of the ignition unit 17 and extend in the same direction as the output terminals 18. When the signal and ignition units 12 and 17 are in place within the housing 1, the output terminals 19 are fitted into the connecting terminals 14 and 15 so as to be electrically connected to the latter.

As shown in FIG. 1, in the disclosed embodiment a metallic cover 20 is provided on the lower side of the ignition unit 17 so as to be partly embedded therein. The metallic cover 20 serves as a heat sink and has the function of dissipating heat generated in the power stage of the semiconductor amplifier to the atmosphere through the housing 1. The cover 20 is not part of the present invention.

The mounting holes 17*a*, the mounting portions 17*b*, the terminals 18 and 19 and the metallic cover 20 are formed into a unitary structure during the molding of the ignition unit 17. Also, the mounting portions 17*b* of the ignition unit 17 are coupled to the supporting portions 12*b* of the signal unit 12 and the output terminals 18 are accommodated in and held by the housing portions 12*d* of the signal unit 12 respectively and the mounting holes 12*c* are aligned with the mounting holes 17*a*. Further the input terminals 19 are fitted into the connecting terminals 14 and 15 so as to be electrically connected to the latter as described above.

A pair of fastening screws 21 are threaded into the aligned mounting holes 12*c* and 17*a* and the screws 21 are screw threaded into the associated threaded holes 1*c* in the housing 1 respectively (see FIG. 1). At that time, the lower cover 20 abuts against the bearing seats 1*a* on the housing 1.

As shown in FIG. 2, a pair of leads 22 are connected at one end to connecting terminals 23 fitted onto and connected to the output terminals 18 of the ignition unit 17 and at the other ends to the ignition coil (not shown) and the electric source (not shown) respectively after the leads 22 have been passed through a grommet 24 fixed to the housing 1 to the exterior of the housing 1. Each of the connecting terminals 23 is preliminarily engaged with and held by the mating housing portion 12*d*.

As shown in FIG. 1, a governor advance device 25 is disposed on the upper extremity, as viewed in FIG. 1, of the hollow cylindrical member 4 and includes a base plate 26 having a pair of mounting members 26*a* symmetrically disposed thereon and provided with respective threaded holes 26*b*.

A molded distribution rotor 27 in the form of a semi-bowl and having one side 27*a* extending substantially on a chord of the circular cross-section of the housing 1 to expose the ignition unit 17 thereto and is fixedly secured to the base plate 26 by a pair of fastening bolts 28 screw threaded into the threaded holes 26*b*. The distribution rotor 27 has a rotor electrode 29 fixed to the upper surface thereof while the rotor electrode 29 includes one end slidably contacting a central electrode 30 through a spring and a carbon brush and the other end successively opposed to a plurality of peripheral electrodes 31 with predetermined gaps formed therebetween. A molded distributor cap 32 in the form of an inverted cylindrical bowl has one end open rigidly fitted onto the housing projection 1*d* so as to be fixed to the housing and the other end has the central electrode 30 centrally extending therethrough and sealed therein and the peripheral electrodes 31 extending therefrom and sealed therein at predetermined equal angular intervals on the peripheral portion thereof.

The embodiment as described above is operated as follows: the internal combustion engine (not shown) is operated to rotate the rotary shaft 2 in the direction of the arrow shown in FIG. 2. The rotation of the rotary shaft 2 causes the hollow cylindrical member 4 to be rotated through the governor advance device 25 resulting in the rotation of the signal rotor 5. Therefore the four protrusions 5*a* on the signal rotor 5 successively approach, come opposite and then are increasingly spaced from the three protuberances 10*a* on the stator 10. Also the permanent magnet 11 produces a magnetic flux Φ flowing therefrom through the movable plate 6, the hollow cylindrical member 4 the signal rotor 5, the protrusions 5*a*, the protuberances 10*a*, the stator 10 and thence to the magnet 11 to interlink with the signal coil 16. Under these circumstances the rotation of the protrusions 5*a* causes a change in that magnetic flux Φ to induce across the signal coil 16 a signal voltage corresponding to the number of rotations per unit time of the engine. The signal voltage thus induced is applied to the input terminals 19 of the ignition unit 17 through the terminals 14 and 15 of the signal coil 16. Therefore the semiconductor amplifier (not shown) in the ignition unit 17 interrupts the current from a DC source (not shown) flowing through the leads 22, the connecting terminals 23 and the output terminals 18 to the primary side of the ignition coil (not shown) at ignition times thereby to induce ignition voltages on the secondary side thereof. The ignition voltages are successively distributed to the prepheral electrodes 31 through the central electrode 30 on the rotating distribution rotor 27.

The disposition of the signal and ignition units 12 and 17 will now be described. The diameter and depth of the housing 1 has heretofore been normally determined by the diameter and axial dimension of components disposed within the housing 1 and also so as to prevent the main body of the distributor on an associated internal combustion engine from interfering with auxiliaries of the engine. Therefore it is extremely important how the ignition unit 17, which has a large volume, is disposed within existing housings without increasing the diameter and depth of the latter. In addition, the ignition unit must be arranged to be easily disposed in and removed from the housing.

In the embodiment of the present invention as shown in FIGS. 1 through 6, a relatively large space has been provided between the signal generator portion and the governor advance device 25 and, even if the number of the protuberances 10*a* on the stator 10 is reduced to three from four, hardly any adverse influences result. According to the present invention the ignition unit 17 is detachably disposed in that space.

Figure 4:
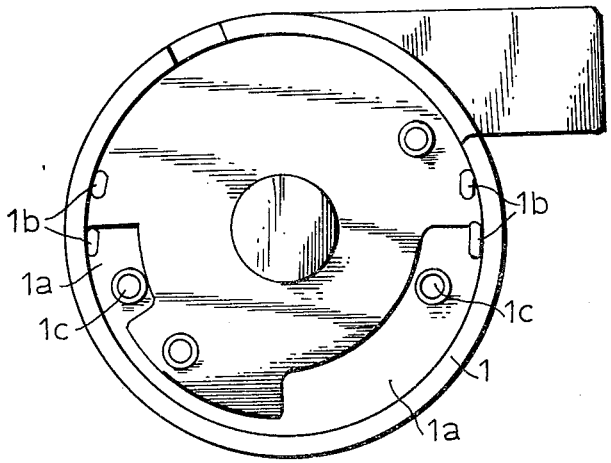
FIG. 4 is a plan view of the interior of the housing shown in FIG. 2.

More specifically, among the four protuberances 10*a* provided on the stator 10, that protrusion previously disposed on the side thereof remote from the link 8 is omitted and instead the bearing seats 1*a* are provided on the inside of the housing 1 on that portion thereof corresponding to the position of the omitted protuberance with the seats axially extended and having a wide surface area and a pair of axially extending protrusions 1*b* are formed at each of two positions approximately diametrically opposite each other with respect to the longitudinal axis of the housing 1 as shown best in FIG. 4.

Then the signal unit 12 is inserted into the housing 1 from the open end thereof and the supporting portions 12*b* thereof abut the bearing seats 1*a* while at the same time each of the positioning portions 12*e* is positioned between and held by the protrusions 1*b* of the respective pairs of protrusions. At that time, the connecting terminals 23 connected to the ignition coil (not shown) and the electric source (not shown) are respectively fitted into and held by the housing portions 12*d* of the signal unit 12.

Following this, the ignition unit 17 is radially inserted across the end of the housing toward the signal unit 12 and the mounting portions 17*b* thereof are coupled to lower parts of the supporting portions 12*b* of the signal unit 12 and the metallic cover 20 on the ignition unit 17 abuts the bearing seats 1*a* in the housing 1 and are held thereagainst. At that time, the input terminals 19 of the ignition unit 17 are fitted into and electrically connected to the connecting terminals 14 and 15 of the signal unit 12 while at the same time the output terminals 18 are fitted into and electrically connected to the connecting terminals 22 in the housing portions 12*d* respectively.

By this movement, the mounting holes 12*a* and 17*a* in the supporting portions 12*b* of the signal unit 12 are aligned with the mounting holes 17*a* in the mounting portions 17*b* of the ignition unit 17 respectively. Therefore a fastening screw 21 is threaded into each set of aligned mounting holes 12*a* and 17*a* until it is screw threaded into the associated threaded hole 1*c* on each of the bearing seats 1*a* of the housing 1 with the result that the signal and ignition units 12 and 17 respectively are fixed to the bearing seats 1*a* to form a unitary structure.

Since the ignition unit 17 is driven hard, it may become disabled. This results in the necessity of exchanging only the disabled ignition unit for a new one.

The present invention permits easy removal of the disabled ignition unit 17 without the removal of the governor advance device 25 and distribution rotor 27.

More specifically, the distributor cap 32 is first removed from the housing 1 and then the distribution rotor 27 is manually rotated until the fastening screws 21 are exposed in the opening between the housing and the edge 27*a*. Then a screw-driver is used to release each screw 21 to remove it from the mating threaded hole 1*c*. Thereafter, the ignition unit 17 is manually drawn out in the direction of the arrow shown in FIG. 3 thereby to remove the mounting portions 17*b* of the ignition unit 17 from the supporting portions 12*b* of the signal unit 12. Therefore the ignition unit 17 is separated from the signal unit 12 and removed from the bearing seats 1*a* of the housing 1.

The easy removal of the ignition unit is possible because of its position above the opening of the housing 1.

In order to mount a new ignition unit 17 in place within the housing 1, the process as described above is reversed. That is, the new ignition unit 17 is first inserted into the housing 1 in a direction opposite to that of the arrow shown in FIG. 3 whereby mounting portions 17*b* are coupled to the lower part of the supporting portions 12*b* of the signal unit 12. Subsequently the fastening screws 21 are used to fix the ignition and signal units 17 and 12 together to the housing 1 to form a unitary structure.

It is noted that, during the operations of mounting and removing the ignition unit, the release of the fastening screws 21 does not result in any displacement of the signal unit 12. This is because, the positioning portion 12*e* disposed on each supporting portion 12*b* thereof is held between a pair of the protrusions 1*b* on housing 1. As a result, the ignition unit 17 can be smoothly mounted in and removed from the housing 1. Also it is possible to automatically assemble the signal and ignition units in the housing.

From the foregoing it is seen that the present invention has the following characteristic features:

(1) Because the ignition unit 17 is fixed to the bearing seats 1*a* of the housing 1, the unit can be extremely easily mounted in and removed from the housing 1. This is because the ignition unit 17 can be inserted into and removed from the housing 1 radially of the latter in the direction of the arrow shown in FIG. 3 without the necessity of removing the governor advance device 25 and the distribution rotor 27 from the housing 1. In addition, the fastening screws 21 and the connecting terminals 23 are arranged to be exposed in the space laterally of the distribution rotor 27. Accordingly, when mounting and removing the ignition unit 17 in and from the housing 1, the ignition unit can be fixed to the housing and connected to the associated components without the necessity of removing the governor advance device 25 and the distribution rotor 27 from the housing 1.

(2) Since the ignition unit 17 and the signal unit 12 are connected in a unitary structure to the bearing seats 1*a* of the housing 1 by the pair of fastening screws 21, it is possible to mount the ignition unit 17 in the small interior of the housing 1. Also the number of mounting seats, fastening screws etc. can be halved as compared with an arrangement in which ignition and signal units are mounted individually in the housing. Along with this, the electrical connection of the ignition unit 17 to the signal unit 12 is achieved by the connecting terminals 14 and 15 being engaged with the input terminals 19 when the two units are fixed to the housing. This ensures that the ignition unit 17 is electrically connected to the signal unit 12 without any erroneous connection and also permits the elimination of leads which lack reliability.

In addition, since the bearing seats are located on the outermost portion of the open end of the housing on the projections, the mounting and removal of the ignition unit on and from the housing is facilitated.

While the present invention has been illustrated and described in conjunction with a single preferred embodiment thereof it is to be understood that numerous changes and modifications may be resorted to without departing from the spirit and scope of the present invention. For example, the ignition unit may have, in addition to the ignition function, an ignition time control function responsive to an ignition signal to automatically advance or retard the associated ignition time in accordance with various control signals. In the latter case, the governor advance device may be omitted. The governor advance device may be disposed below the signal and ignition units 12 and 17 respectively. Further the signal and ignition units 12 and 17 respectively may be separately disposed in the housing 1. Also those units may be disposed on the inner wall surface of the housing 1.

What we claim is:

1. An ignition device for an internal combustion engine, comprising: a housing; a rotary shaft journalled in said housing; a signal unit mounted in a predetermined position within said housing and having a signal coil for generating ignition signals due to the rotation of said rotary shaft; and an ignition unit adjacent to said signal unit within said housing laterally thereof with respect to the axis of said shaft, said ignition unit including a semiconductor amplifier circuit for receiving said ignition signals and for controlling a current flowing through an ignition coil, said signal unit having a portion laterally opposed to said ignition unit and having a pair of output terminals, and said ignition unit having a portion laterally opposed to said signal unit and having a pair of input terminals mechanically and electrically connected to said output terminals for mechanically and electrically connecting said units.

2. An ignition device for an internal combustion engine, comprising: a housing; a rotary shaft journalled in said housing; a signal unit mounted within said housing for generating ignition signals due to the rotation of said rotary shaft, and having a laterally facing flat end portion having a pair of output terminals extending perpendicularly thereto; and an ignition unit mounted within said housing and having a portion opposed to said flat end portion of said signal unit and a pair of input terminals on said opposed portion detachably mechanically engaged with and electrically engaged with said output terminals on said signal unit, said ignition unit further having a pair of output terminals for connection to an ignition coil, said ignition unit input and output terminals extending in a common direction, said ignition unit being against said flat end portion of said signal unit and being detachably mounted in said housing for movement into and out of said housing radially with respect to the axis of said shaft.

3. An ignition device as claimed in claim 2 in which said signal unit includes a bobbin portion disposed coaxially with the longitudinal axis of said rotary shaft and a signal coil wound around said bobbin portion for generating said ignition signal.

4. An ignition device as claimed in claim 3 in which said flat end portion is on said bobbin portion.

5. An ignition device as claimed in claim 2 in which said pairs of said ignition unit input and output terminals are symmetrically disposed relative to said shaft.

6. An ignition device as claimed in claim 2 in which said ignition unit has a cross-section which is substantially semi-circular in shape.

7. An ignition device for an internal combustion engine, comprising: a housing; a rotary shaft journalled in said housing; a signal unit mounted within said housing for generating ignition signals due to the rotation of said rotary shaft, said signal unit having a laterally facing flat end portion and having a pair of housing portions on opposite sides of said signal unit and extending in a common direction; a connecting terminal in each of said housing portions, one of said connecting terminals being for connection to an ignition coil; and an ignition unit mounted in said housing opposed to said flat end portion of said signal unit and having a pair of output terminals mechanically fitted into and electrically connected to said connecting terminals in said housing portions.

8. An ignition device as claimed in claim 7 in which said ignition unit and said signal unit are integrally mounted in said housing with said output terminals of said ignition unit frictionally fitted into and electrically connected to said connecting terminals of said signal unit.

9. An ignition device as claimed in claim 7 in which said signal unit includes a bobbin portion disposed coaxially with the longitudinal axis of said rotary shaft and a signal coil wound around said bobbin portion for generating said ignition signals, and said housing portions are symmetrically located on opposite sides of bobbin portion.

10. An ignition device for an internal combustion engine, comprising: a housing; a rotary shaft journalled in said housing; first positioning means disposed in said housing; a signal unit for generating ignition signals due to the rotation of said rotary shaft and being within said housing and having second positioning means thereon engaging said first positioning means for positioning said signal unit in said housing; an ignition unit within said housing positioned laterally of said signal unit and being interfitted with said signal unit; said units each have at least one laterally projecting portion extending toward the other unit, the laterally projecting portion on one unit overlying the laterally projecting portion on the other unit, and a fastening screw extending through the overlying laterally projecting portions and fixing said units to said housing.

11. An ignition device as claimed in claim 10 in which said first positioning means is at least one pair of spaced projections on the inner surface of said housing, and said second positioning means is at least one portion of said signal unit engaged between said pair of spaced projections.

12. An ignition device for an internal combustion engine, comprising: a housing; a rotary shaft journalled in one end of said housing and the other end of said housing opening away from said one end; a cap fitted over said open end of said housing; a signal unit in said housing for generating ignition signals in response to rotation of said rotary shaft; a bearing seat in said housing and extending at least to the plane of the open end of said housing; an ignition unit detachably mounted directly on said bearing seat for receiving an ignition signal for the internal combustion engine and sending it to an ignition coil to generate an ignition voltage, said signal unit having connecting housing portions thereon extending toward the position of said ignition unit with electrical connection means thereon, and said ignition unit having complementary mounting portions engaged with the connecting housing portions by movement of said ignition unit laterally of said shaft along the surface of said bearing seat and having electrical connection means thereon engagable with the electrical connection means on said connecting housing portions by said movement; and fastening means extending through said connecting housing portions and said complementary mounting portions and into said bearing seat for detachably securing said ignition unit to said bearing seat.

* * * * *